United States Patent [19]

Saunders

[11] Patent Number: 4,865,007

[45] Date of Patent: Sep. 12, 1989

[54] FALL-AWAY ARROW REST ASSEMBLY

[75] Inventor: Eugene F. Saunders, Columbus, Nebr.

[73] Assignee: Saunders Archery Co., Columbus, Nebr.

[21] Appl. No.: 318,618

[22] Filed: Mar. 3, 1989

[51] Int. Cl.[4] ..... F41B 5/00

[52] U.S. Cl. ..... 124/41 A; 124/24 R; 124/86; 124/88

[58] Field of Search ..... 124/23 R, 24 R, 41 A, 124/86, 88

[56] References Cited

U.S. PATENT DOCUMENTS

| | | | |
|---|---|---|---|
| 2,691,974 | 10/1954 | Nelson | 124/41 A |
| 2,743,716 | 5/1956 | Wendt | 124/41 A |
| 4,133,334 | 1/1979 | Tone | 124/41 A |
| 4,343,286 | 8/1982 | Thacker | 124/24 R |
| 4,676,220 | 6/1987 | Pietraszek | 124/41 A |
| 4,703,745 | 11/1987 | Hammond | 124/41 A |
| 4,803,971 | 2/1989 | Fletcher | 124/41 A |

*Primary Examiner*—Randolph A. Reese

*Assistant Examiner*—John A. Ricci

*Attorney, Agent, or Firm*—Michael G. Berkman

[57] ABSTRACT

A frame-carried arrow rest and sideplate assembly fastened to a bow at a sight window thereof. A pin-mounted arm of the rest of the assembly is supported in a outwardly-extending, arrow-supporting mode by means of an arcuately-pivotal frame-carried support block ("sideplate") to which the arm is releasably coupled. Frictional forces applied laterally against the pivotal block upon release of the arrow and travel of the arrow shaft forwardly cause the block to pivot and to decouple from and to release the arm. The latter than falls downwardly and away, gravitationally, from its arrow-shaft supporting position to establish a clear and unobstructed travel path for the arrow shaft and its fletching as the arrow is launched in flight. It is a feature of the present invention that the arrow rest arm, and the block as well, shift so as to be completely clear of a zone traversed by the fletching of the released arrow, thus to obviate interference with the intended trajectory of the arrow and to prevent the generation of undesirable noise.

8 Claims, 3 Drawing Sheets

FALL-AWAY ARROW REST ASSEMBLY

BACKGROUND OF THE INVENTION

The present invention relates, generally, to an arrow rest assembly for archery use. More particularly, the invention is directed to an arrow rest which markedly reduces, or which eliminates completely mechanical interference between the shaft-supported component of the rest and the sideplate of the assembly with the fletching of the arrow itself. Arrow rests have long been used as a support platform, above the shelf of the bow window, over which to draw and fire the arrow when shooting and also to prevent the arrow from dropping while nocking. Additionally, in order to prevent objectional contact of the arrow with the wood of the window, plates or sideplates have been fastened on the side of the window to prevent arrow slap and the resulting erratic shooting.

The general purpose of the structures described has been to provide, in combination, a stable platform or undersupport and an arrow shaft cushioning plate at the side of the window, against which the arrow shaft abuts. Many different mechanical arrangements using a diverse selection of structural materials have been employed.

In years past, an archer used the upper section of his hand as an arrow rest. Then, in bows having sight windows, the bare shelf was relied upon as a rest. Soft or bristly materials such as feathers, carpet and mohair on which the arrow shaft could ride, have been cemented to the shelf, as a rest. Leather and low-friction plastic sheet materials of poly-halogenated hydrocarbon compositions (Teflon or Tel-X) or other high-lubricity plastics (e.g. Delrin) have been adhesively secured or otherwise fastened to the side of the bow to prevent arrow shock and noise.

In other arrangements, wire finger-style rests have been devised. In still others, low-friction plastic has been used as a rest, and in one system, the plastic itself overlies and is supported on a spring rest, with a cushioning or soft material on the window wall, as a sideplate. Stiff plastic, shelf-like rests, fastened to the bow window have been found useful, especially on bows which have radius risers and no suitable well-defined shelf. In addition to the use of springs in shelf rests, window wall sideplates of various compositions have been designed, including with plungers or with spring-tension mechanisms for absorbing the "noise factor", shock and pressure of the arrow on firing, and to prevent "arrow slap".

From the foregoing it will be appreciated that the structural configurations of arrow rests, in conjunction with the sideplates in archery bows have taken many and varied forms. The principal goals sought have been to ensure rapid and effective arrow shaft positioning, proper support and guidance, and to absorb shock and pressure at the moment of firing—all without interfering with the intended flight trajectory and without generating objectionable noise.

In spite of the wide-spread interest in arrow rests and bow-mounted sideplates, and notwithstanding the extensive researches and experimental work conducted in this area of archery bow accessories, no completely satisfactory device has heretofore been produced. Each prior art physical embodiment has one or more objectional features. It is, therefore, an aim of the present invention to provide a useful combination arrow rest and sideplate in which deficiencies noted in prior art devices are obviated.

SUMMARY OF THE INVENTION

The present invention constitutes a frame-carried assembly including an intercoupled rest and guide block (sideplate). An arrow-shaft support arm of the assembly is pivotally secured to the frame for articulation with reference thereto. The arm is pivotally positionable between a horizontal, arrow-supporting mode and a gravitationally-induced fall-away, vertical, arrow-disengaging mode.

The guide block (sideplate) is positioned laterally of to abut an arrow shaft as the guide therefor. Pivotally mounted on the frame, the block is responsive to frictional force applied laterally thereagainst to traverse a horizontal arc, to effect decoupling from and release of the arrow support arm, and, simultaneously, to establish an unobstructed passageway to be traversed by the arrow upon its release from the bow.

It is an important feature of the present invention that the combination arrow rest and guide block functions so as to support and guide an arrow shaft in its drawn mode and that, when the arrow is released in flight, both the arm and the guide block automatically shift to provide an unimpaired and unobstructed flight path or open arrow gets in the zone of the bow window.

Specific features of the invention are that there are provided intercoupling structures for releasably maintaining the arrow rest arm and the arrow-shaft abutment block in a shaft-supporting and arrow-guiding mode, and that the arm and block are effectively and promptly decoupled upon release of the shaft, the latter frictionally engaging and causing the block to pivot out of the flight path of the arrow and simultaneously to disengage from the rest arm, thus allowing the arm to fall away from its extended, shaft-supporting attitude.

An important object of the present invention is positively, promptly and silently to remove the arrow from physical contact with the arrow rest and the guiding sideplate, immediately upon release of the arrow in flight.

A related feature of the arrow rest assembly of the invention is that the automatically achieved physical displacement of the fall-away rest and the swing-away or pivot-away guide block minimize erratic flight and prevent arrow slap.

An important advantage of the arrow rest assembly of the invention is that it promotes increased accuracy by removing mechanical impediments which would otherwise interfere with and adversely affect the flight of the arrow upon its release.

Another feature of the arrow rest assembly of the invention is the provision of a rest-arm-carried boss for limiting lateral displacement of the arrow shaft and for guiding the arrow at the instant of its release.

An important feature of the invention is that the side block is limited to a sector and is frictionally engaged by the arrow shaft and pivoted to retract to a position out of the flight path traversed by the fletching of the arrow, allowing the fletching to pass the bow window smoothly and ensuring a cleaner, faster, and truer arrow in flight.

Yet another principal feature of the arrow rest assembly of the invention is that as the guide block is rotated, as a result of frictional forces applied thereagainst by the arrow shaft, the rest arm, which is intercoupled with and supported by the block, is decoupled from the block and swings downwardly, gravitationally, out of the path traversed by the arrow when released.

A related, unique feature of the invention is that both the retraction of the guide block (sideplate) and the "fall-away" of the rest arm occur before the fletching of the arrow reaches the handle zone of the bow, so that arrow flight interference is avoided.

In a preferred embodiment of the invention, a lateral face of the guide block, which abuts the arrow shaft, is grooved annularly to define a trough-like recess which a sidewall portion of the arrow shaft invades for frictional engagement.

Another important feature of the arrow rest assembly of the invention is that there is provided a block-carried detent for operational engagement with the support arm to prevent an oscillatory swinging rebound of the block when the block is decoupled from the fall-away arm during flight release of the arrow shaft.

In a preferred embodiment of the invention, a block-carried detent and an extending end of the support arm are disposed to contact one another during pivotal displacement of the block and concurrent fall-away of the support arm, the contacting serving to enhance and to ensure a completion of the arcuate travel of the block through a full 180°.

Other and further objects, advantages and features of the invention will become apparent from a reading of the following specification considered in conjunction with the drawings.

DETAILED DESCRIPTION OF ILLUSTRATED EMBODIMENT

Figure 1:
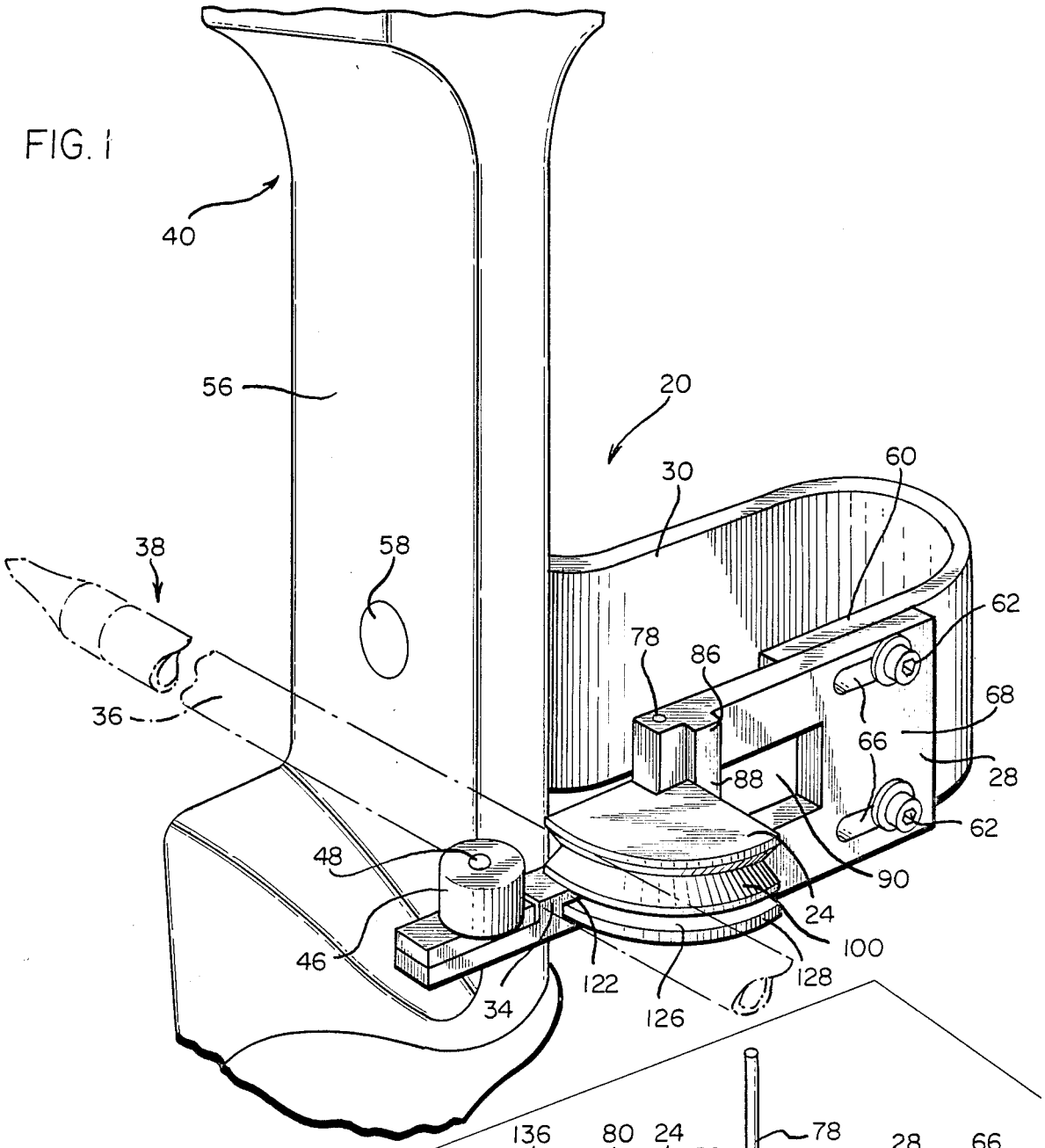
FIG. 1 is an enlarged, perspective view of a fall-away arrow rest in accordance with the present invention, and showing the device in an arrow-shaft-supporting mode.

The aims and objects of the invention are accomplished by providing, for archery use, a frame-carried assembly which includes, in combination, an arrow rest arm releasably intercoupled with a guide block which serves as a sideplate, and in which frictional forces applied laterally to and along the guide block effect a pivotal displacement of the block, arcuately, to shift the block out of the flight path of the arrow fletching. At the same time, the block decouples from the supported arrow rest arm, whereupon the arm swings downwardly, gravitationally, to assume a mode which is also clear of the zone traversed by the arrow fletching upon release of the arrow from the bow. In the structural arrangement and operation described, immediately upon release of the arrow, both the side guide or "sideplate" and the arrow rest (support arm) are physically effectively removed from the zone to be traversed by the arrow fletching as the arrow is shot from the bow. Interference with a true flight path is obviated and disrupting noises of the type normally associated with arrow release are avoided.

Referring now to the drawings, for purposes of disclosure, the combination arrow rest and arrow-shaft guide assembly 20 of the invention is shown as embodying an arrow shaft guide block 24 carried in a yoke 28 secured to a bow-mounted bracket 30. Hingedly carried by the yoke 28 and releasably coupled to the guide block 24 is an arm 34 which serves as a rest or support for the shaft 36 of an arrow 38 to be released from the bow 40. In a preferred embodiment of the invention there is mounted on the arm 34 at an end 42 remote from the guide block 24, a wheel-like boss 46 rotatably secured on a pin 48 and operational to abut and guide an arrow shaft at the instant of its release from the bow. The boss 46 is selectively positionable laterally by means of cooperating bolts 50 and slots 52 (FIG. 3) to adjust the spacing between the boss 46 and the block 24.

As indicated in the perspective view of FIG. 1, the generally V-shaped bracket 30 of the rest assembly 20 is attached at an arm 54 (FIGS. 5 and 6) of the bracket 30 to the handle riser section 56 of the bow 40 by means of a bolt 58. The yoke is adjustably secured to a leg 60 of the bracket 30 by a pair of bolts 62 passing through slots 66 formed in the body 68 of the block-carried yoke 28. The slots 66 allow lateral adjustment in positioning the guide block 24 to accommodate specific bow configurations and the archer's personal requirements.

Figure 2:
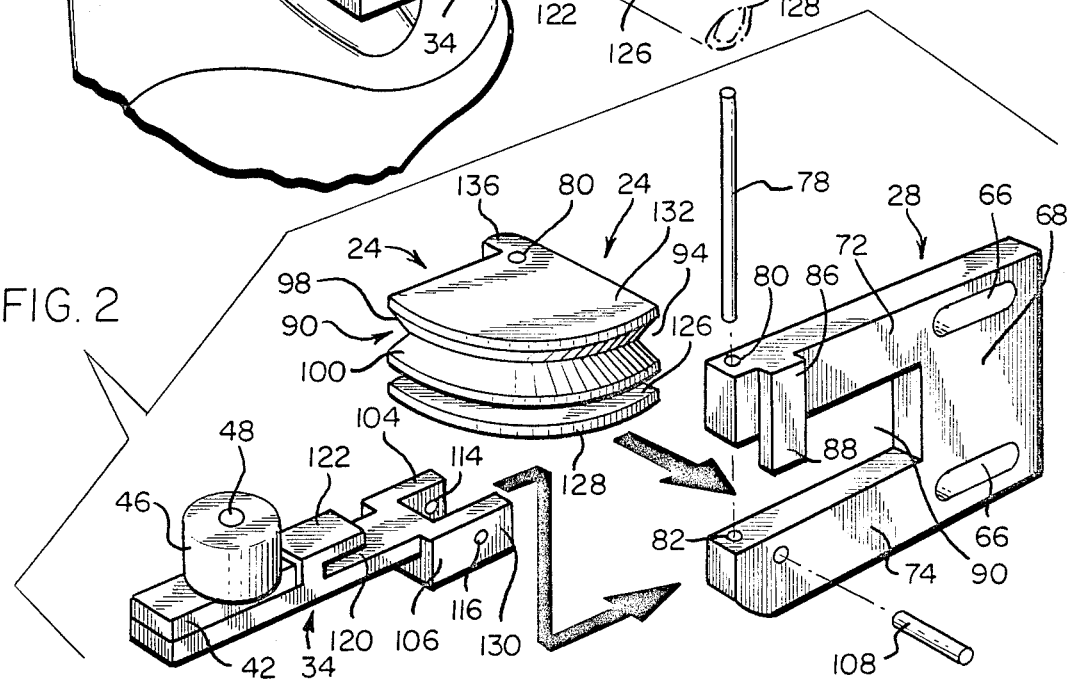
FIG. 2 is an exploded view depicting the three principal mechanical elements of the arrow rest of the invention and the manner of assembly.

As shown in FIG. 1 and in the exploded view of FIG. 2, the guide block 24 is pivotally mounted between upper and lower arms 72 and 74 of the yoke 28 on a vertical shaft 78 passing through a bore 80 in the block 24 and secured in cooperating, in-line bores 80 and 82 formed in the yoke arms 72 and 74.

Figure 4:
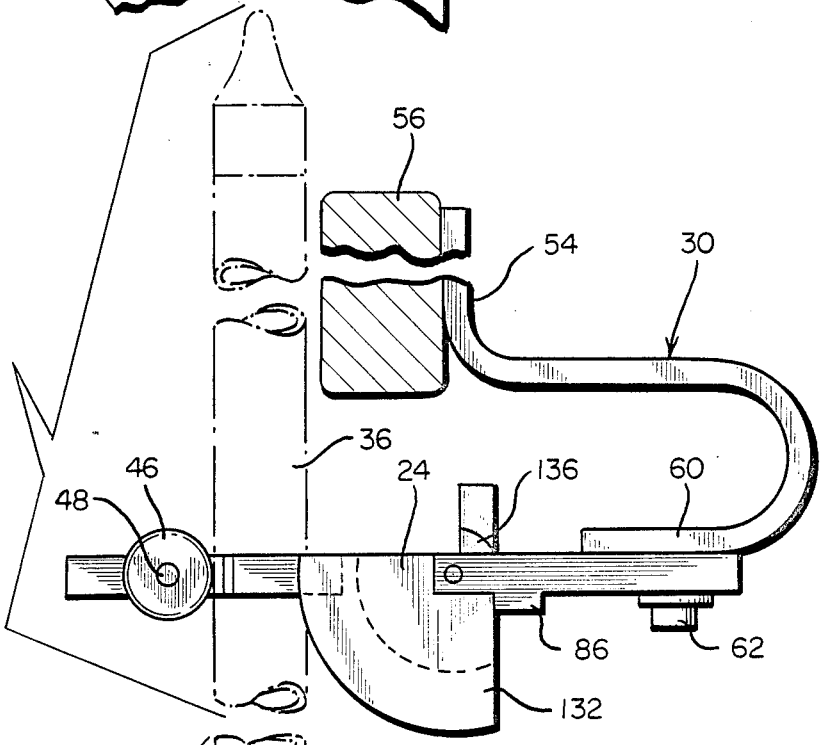
FIG. 4 is a top plan view of the structure shown in FIG. 3, and in arrow-supporting configuration.
Figure 5:
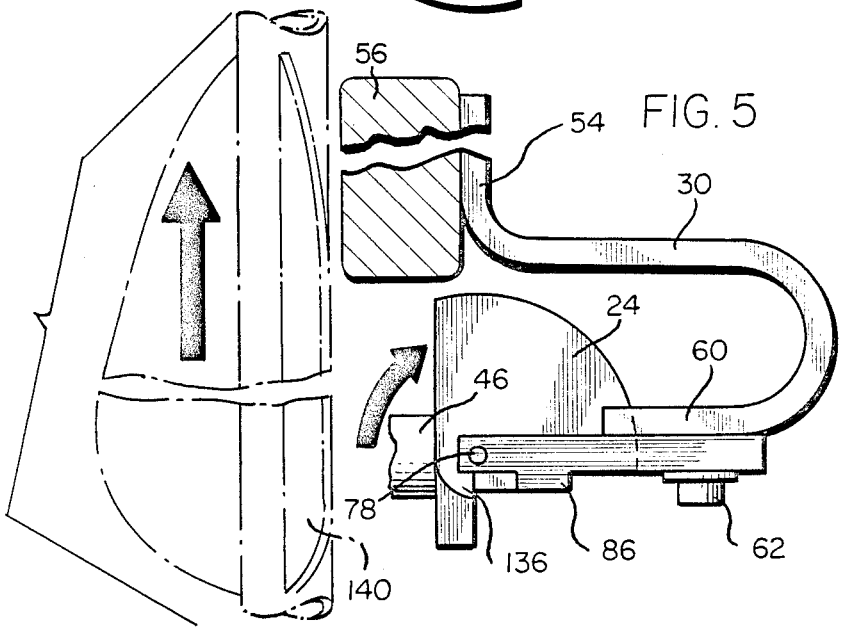
FIG. 5 is a view similar to that shown in FIG. 4, but with the arrow-shaft-supporting arm in a non-supporting mode, effected through arrow-shaft-induced functional pivotal, rotational displacement of an arrow-shaft-supporting block of the arrow rest.

A stop 86 which is mounted on the upper arm 72 has an end 88 which extends downwardly to invade the opening or window 90 between the arms 72 and 74 of the yoke 28 to limit the arcuate travel of the block 24 as it turns or pivots on the shaft 78 (FIGS. 4 and 5).

Figure 3:
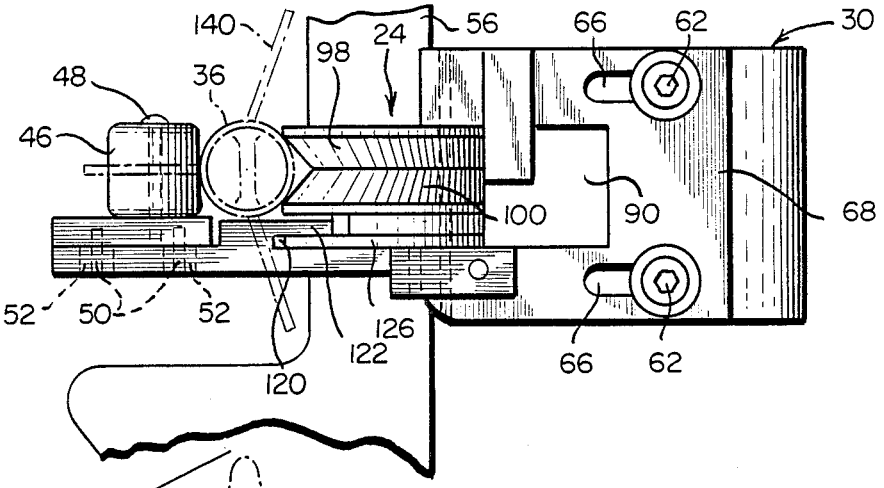
FIG. 3 is an enlarged, fragmentary front elevational view of the arrow rest of the invention as fastened to the supporting bow.

Referring further to FIGS. 1 and 2 and to FIGS. 3 and 4, the guide block 24 is shown in the form of a disc quadrant rotatable through an arc of about 180°. A bounding perimetric arcuate face of the sector-like block 24 is formed with a groove 94 defining a generally V-shaped indentation into the face 96 of the block 24 and coextensive therewith. The groove 94 is bounded by a pair of opposed angularly disposed upper and lower guide walls 98 and 100 for frictionally engaging a contacting cylindrical outer wall of an arrow shaft 36 brought into engagement therewith during nocking of the arrow (FIG. 1).

The rest arm 34, in the embodiment of the invention illustrated, is formed with a pair of laterally-spaced, inwardly-projecting legs 104 and 106 which bridge the lower arm 74 of the yoke 28 and are pivotally joined to the arm 74 by means of a coupling hinge pin 108 passing through a bore 110 formed in the arm 74 and a pair of cooperating, co-aligned openings 114 and 116 formed in respective legs 104 and 106, as indicated schematically in FIG. 2. Adjacent a longitudinal mid-zone thereof, the arm 34 is formed with an outwardly opening transverse and longitudinal groove 120 and a coextensive surmounting plate 122. The block 24 is formed with an outwardly opening arcuate groove 126 for slidably mating with the plate 122 of the arm 34, and an arcuate plate 128 for mating or coupling with the groove 120 of the arm 34, as shown in FIG. 1.

Figure 6:
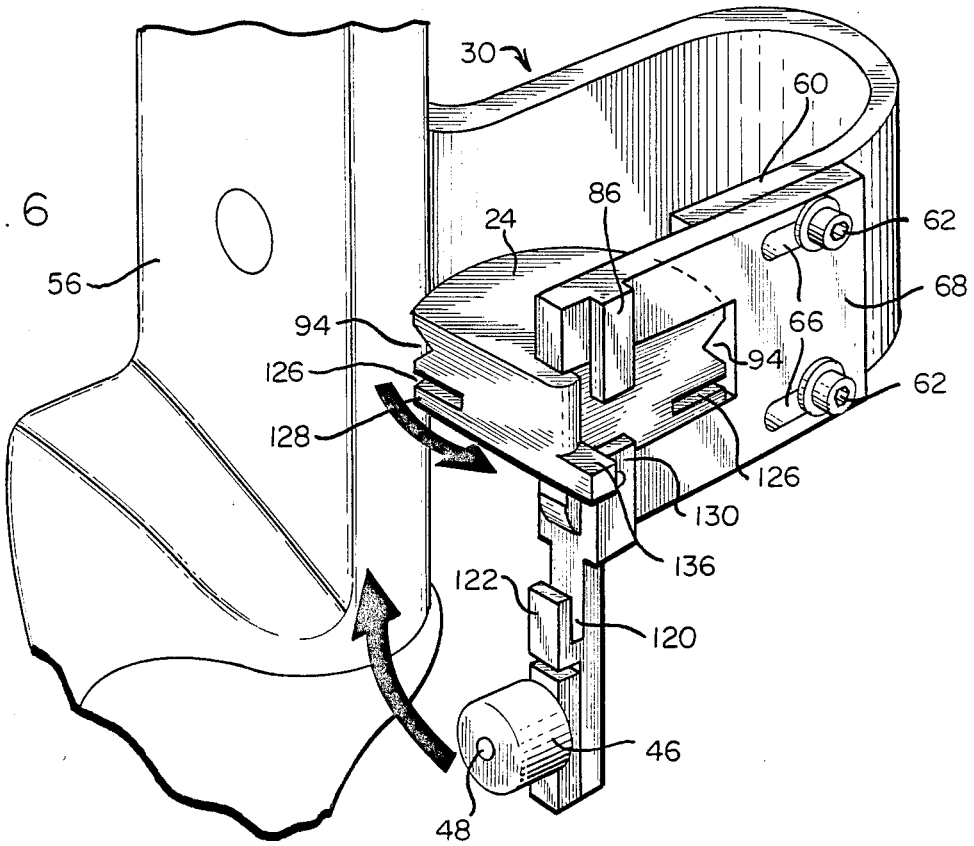
FIG. 6 is an enlarged perspective view of the apparatus of FIG. 1, but showing the configuration of the assembly in a fall-away mode of the arrow-shaft-supporting arm, upon rotation of the arm-engaging pivotal block, effecting release of the arm.
Figure 7:
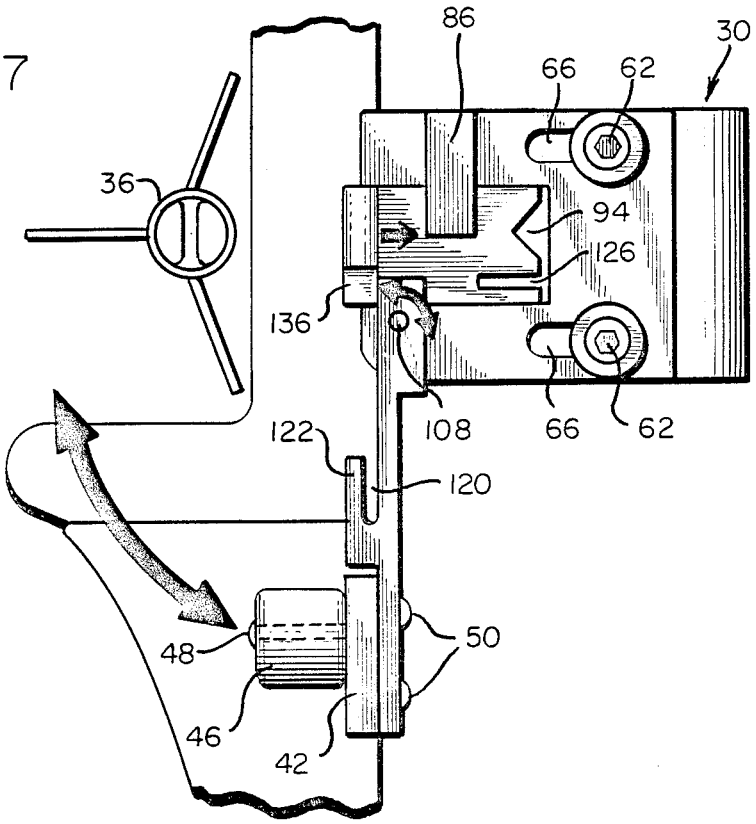
FIG. 7 is a rear elevational view of the structure shown in FIG. 5, with the arm-support block pivoted to release the arm, and the latter shown in a hanging, fallen-away mode.

As shown in FIG. 2, the near leg 106 of the legs 106 and 104 bracketing the yoke arm 74 is somewhat longer than the opposed leg 104 and forms an extension 130. The body 132 of the guide block 24 is formed with a stub-like protrusion 136. When the arm 34 and the block 24 disengage, as occurs when forward movement of the arrow shaft 36 causes the block 24 to turn on its axis 78, the arm 34 falls away and swings to assume a vertical mode (FIGS. 6 and 7). Any propensity of the block objectionably to reverse its pivot path or to rebound and thus to reenter the spacial zone it previously occupied is prevented as the protrusion 136 of the block 24 abuts the extension 130 of the leg 104. As shown in FIG. 6, and as indicated schematically in FIG. 7, the force necessary to return the block 24 toward its arrow-shaft-engaging position shown in FIGS. 1 and 4 would include that force required forceably to displace and pivotally to elevate the rest arm 34 to its arrow-supporting mode, shown in FIGS. 1, 3 and 4.

When the block 24 turns beyond its initial 90° of arc travel, during which period the block 24 is in contact with the shaft 36 of the arrow 38, the block 24 and the rest bar 34 disengage and the bar 34 "falls-away". At the same time, the extension 130 on the bar 34 comes to bear against the protrusion 36 of the block 24 urging the block body to complete its 180° of travel and to enter the window 90 and abut the stop 88, and the end 30 of the vertically disposed arm 34.

It is believed that the novel operation and attendant functional advantages of the combination arrow rest 34 and sideplate 24 of the invention will be apparent from the foregoing description. It will be evident that when an arrow 38 is nocked on the bow string, the shaft 36 of the arrow 38 rests on the bar 34, between the block (sideplate) 24 and the roller guide 46, the arrow shaft 36 abutting and bearing against the walls 98 and 100 bounding the groove 94 in the block 24, as shown in FIGS. 1, 3 and 4.

Upon release of the arrow 38, the forwardly moving shaft 36, which is in frictional engagement with the block 24 (the "sideplate") causing the guide block 24 of the rest assembly to pivot or turn on its support pin 78 through a quadrant arc, representing 90° of arc in which the arrow shaft 36 is in impelling contact with the guide block 24. The forces impressed upon and transferred to the block 24 by the arrow shaft 36 imparts to the block 24 momentum which is sufficient not only to pivot 90°, correlated with the extent of or duration of direct contact, but also to continue its arcuate free travel until the block 24 engages the mechanical stop 88. Positive mechanical assistance to the realization of this full 180° of displacement of the block 24 is provided by the pressure applied by the extension 130 of the rest arm 34 against the protrusion 136 on the body of the block 24 as the block pivots beyond its first 90° of travel, and the assembly assumes the configuration shown in FIGS. 5, 6 and 7.

The structural configuration achieved, in accordance with the practice of the present invention, when the arrow shaft 36 bears upon the guide block 24 and moves forwardly is one in which both the rest arm 34 assembly and the sideplate, guide block 24, move completely out of the travel zone traversed by the arrow 38 in its flight from the bow, leaving an open travel route. An important effect of this achievement, contributing to archery accuracy and archery prowess, it that the arrow fletchings 140 pass the bow window zone without mechanical engagement or interference. The sight trajectory remains true. Side slap is eliminated. Noises are avoided.

While the present invention has been described with reference to a preferred embodiment, it is obvious that many changes may be made in the size, shape, details and arrangement of the various elements of the invention without departing from the scope and spirit thereof. It is, therefore, intended to include within the appended claims all such variations and modifications.

What is claimed is:

1. An arrow rest, including frame means and fastening means for securing said frame means to an archery bow, arm means, and pin means pivotally securing said arm means to said frame means for articulation with reference to said frame means, said pin means rendering said arm means pivotably positionable between a horizontal, arrow-supporting mode and a gravitationally-induced fall-away, vertical, arrow-disengaging mode, frame-mounted, arcuately-swingable, sector-like block means for laterally abutting an arrow shaft as a guide therefor, said block means including means for mechanically coupling with said arm means for sustaining said arm means in an outwardly-extending arrow-supporting mode when an arrow is nocked on the bow, said block means being responsive to frictional forces applied laterally thereagainst to pivot through a horizontal arc for decoupling from and releasing said arm means to allow said arm means gravitationally to fall away from an arrow-shaft-supporting disposition in said arrow rest when an arrow is shot from the bow.

2. The structure as set forth in claim 1 and further comprising boss means supported on said arm for engaging and limiting lateral displacement of an arrow shaft and for guiding the shaft during release of an arrow from the bow, and wherein said arm means and said block means delineate an upwardly opening, generally U-shaped, open window-like, through passageway traversed by the arrow in its travel upon release from the bow.

3. The structure as set forth in claim 2 and further comprising rod means fastened in and projecting generally normally of said arm means for defining a spindle about which said boss means mounted thereon rotates upon release of an arrow from the bow.

4. The structure as set forth in claim 2 wherein said laterally-presented bounding wall means of said block means defines a circumambient, trough-like, arrow-shaft-engaging configuration.

5. The structure as set forth in claim 1, and further comprising shaft means pivotally securing said block means for arcuate rotation in a horizontal plane, and wherein said block means defines laterally presented bounding wall means for abutting and for frictionally embracing an arrow shaft moving forwardly and thereagainst during propulsion of the arrow from the bow, thereby to impart arcuate pivotal rotation to said block means about said shaft means to decouple said arm means from said block means and to release said arm means for swinging downwardly to abandon an arrow-shaft-supporting attitude.

6. The structure as set forth in claim 1 and further comprising detent means operational between said arm means and said block means for deterring oscillatory swinging rebound of said block means upon pivotal displacement of said block means and concurrent release of said arm means when an arrow is shot from the bow.

7. The structure as set forth in claim 6 wherein said detent means comprises, in interference orientation, a stub-like protrusion extending radially from said block means and along a front face thereof, and an extension of said arm means disposed beneath said block means at an end of said bar means remote from said boss means, and beyond a pivotal axis of said bar means, said extension on said arm means pivotally invading a horizontal plane traversed by said protrusion on said block means, to abut said protrusion at a rear face thereof when said block means swings to a bar-means-releasing mode.

8. The structure as set forth in claim 7 wherein said protrusion on said block means constitutes means for engaging said extension of said arm means pivotally to urge said arm means upwardly to return to a horizontal, block-means-coupled mode and to effect recoupling of said plate means and said slot means when said block means is rotated manually to an arrow-shaft-guiding disposition.

* * * * *